US011118354B2

(12) United States Patent
Tang et al.

(10) Patent No.: US 11,118,354 B2
(45) Date of Patent: Sep. 14, 2021

(54) ROOFING PRODUCTS WITH ZONES OF ALGAE-RESISTANT GRANULES AND METHOD OF MANUFACTURE

(71) Applicant: CertainTeed LLC, Malvern, PA (US)

(72) Inventors: Xiaofeng Tang, Malvern, PA (US); Shuang Liu, Malvern, PA (US); Robert L. Jenkins, Honey Brook, PA (US); Mark W. Simon, Phoenixville, PA (US)

(73) Assignee: CertainTeed LLC, Malvern, PA (US)

( * ) Notice: Subject to any disclaimer, the term of this patent is extended or adjusted under 35 U.S.C. 154(b) by 0 days.

(21) Appl. No.: 16/728,173

(22) Filed: Dec. 27, 2019

(65) Prior Publication Data

US 2020/0208405 A1 Jul. 2, 2020

Related U.S. Application Data

(60) Provisional application No. 62/785,532, filed on Dec. 27, 2018.

(51) Int. Cl.
*E04D 1/00* (2006.01)
*E04D 13/00* (2006.01)
*E04D 1/26* (2006.01)

(52) U.S. Cl.
CPC ..... *E04D 13/002* (2013.01); *E04D 1/26* (2013.01); *E04D 2001/005* (2013.01)

(58) Field of Classification Search
CPC .... E04D 1/12; E04D 1/22; E04D 1/26; E04D 1/265; E04D 1/28; E04D 1/2963; E04D 1/20; E04D 13/002
USPC ..... 52/555, 518, 554, 557
See application file for complete search history.

(56) References Cited

U.S. PATENT DOCUMENTS 3,484,267 A * 12/1969 Sadler ..... E04D 1/26 52/518
4,092,441 A * 5/1978 Meyer ..... A01N 59/16 106/18.35
5,666,776 A * 9/1997 Weaver ..... E04D 1/26 52/314
7,510,622 B2 * 3/2009 Kalkanoglu ..... B26D 5/34 156/278
7,788,870 B1 * 9/2010 Spencer ..... E04D 13/002 52/518

(Continued)

*Primary Examiner* — Kyle J. Walraed-Sullivan
(74) *Attorney, Agent, or Firm* — McDonnell Boehnen Hulbert & Berghoff LLP

(57) ABSTRACT

The present disclosure relates generally to roofing products, for example, suitable for use covering and protecting the roofs of structures. The present disclosure relates more particularly to a roofing product including an upper section and an exposed section. The roofing product includes a substrate having a top surface and a bottom surface, and a plurality of zones of roofing granules disposed on the top surface of the substrate. The plurality of zones includes first, second and third zones within the exposed section. The first zone includes a first collection of algae-resistant roofing granules and has a first algae-resistance intensity. The second zone includes a second collection of algae-resistant roofing granules and has a second algae-resistance intensity. The third zone has a third algae-resistance intensity that is different from the first algae-resistance intensity.

15 Claims, 7 Drawing Sheets

(56) References Cited

U.S. PATENT DOCUMENTS 8,058,342 B1 * 11/2011 Stevens ..... C08K 5/0008 524/560
8,394,498 B2 * 3/2013 Shiao ..... G02B 1/00 428/403
8,703,166 B1 * 4/2014 Flynn ..... A01N 25/12 424/409
8,776,471 B2 7/2014 Jenkins et al.
9,243,409 B2 1/2016 Kalkanoglu et al.
9,334,654 B2 5/2016 Kalkanoglu et al.
2002/0160151 A1 * 10/2002 Pinault ..... B32B 11/04 428/144
2006/0172643 A1 * 8/2006 Greaves ..... B32B 27/08 442/136
2007/0020436 A1 * 1/2007 Teng ..... E04D 1/26 428/148
2007/0026195 A1 * 2/2007 Pinault ..... B05D 5/02 428/141
2007/0039252 A1 * 2/2007 Railkar ..... E04D 13/002 52/44
2007/0068108 A1 * 3/2007 Kiik ..... E04D 1/26 52/518
2007/0148342 A1 * 6/2007 Kalkanoglu ..... A01N 25/12 427/212
2007/0261337 A1 * 11/2007 Whitaker ..... C04B 26/26 52/300
2008/0026183 A1 * 1/2008 Vanpoulle ..... E04D 13/002 428/143
2008/0118640 A1 * 5/2008 Kalkanoglu ..... C04B 20/12 427/186
2008/0131664 A1 * 6/2008 Teng ..... E04D 13/002 428/144
2008/0261007 A1 * 10/2008 Hong ..... E04D 7/005 428/216
2009/0282767 A1 * 11/2009 Grubka ..... E04D 1/30 52/518
2010/0240526 A1 * 9/2010 Hong ..... C01G 23/047 502/84
2011/0104422 A1 * 5/2011 Kalkanoglu ..... B29B 17/00 428/41.8
2011/0104440 A1 * 5/2011 Kalkanoglu ..... C04B 35/62821 428/143
2011/0258956 A1 * 10/2011 Felton ..... E04D 1/20 52/518
2012/0157583 A1 * 6/2012 Shiao ..... C04B 26/26 524/64
2012/0192510 A1 * 8/2012 Spencer ..... E04D 13/00 52/173.1
2012/0324807 A1 * 12/2012 Spencer ..... E04D 13/002 52/173.1
2013/0025226 A1 * 1/2013 Jenkins ..... E04D 1/26 52/557
2013/0042561 A1 * 2/2013 Kalkanoglu ..... B05D 5/061 52/518
2014/0208675 A1 * 7/2014 Beerer ..... E04D 1/26 52/506.01
2014/0338284 A1 * 11/2014 Spencer ..... E04D 7/005 52/741.3
2015/0240495 A1 * 8/2015 Vermilion ..... E04D 1/20 428/142
2015/0315789 A1 * 11/2015 Buzza ..... E04D 1/20 52/526
2016/0244969 A1 * 8/2016 Beerer ..... E04D 1/28
2016/0265229 A1 * 9/2016 Leitch ..... E04D 1/26
2017/0101783 A1 * 4/2017 Edgson ..... E04D 1/30
2017/0175393 A1 * 6/2017 Leitch ..... E04D 1/26
2017/0284100 A1 * 10/2017 Jenkins ..... B32B 5/142
2018/0187419 A1 * 7/2018 Lai ..... B32B 5/16
2019/0284807 A1 * 9/2019 Freiborg ..... B32B 5/16
2019/0383017 A1 * 12/2019 Sa ..... E04D 13/002
2020/0018068 A1 * 1/2020 Smith ..... E04D 1/20

* cited by examiner

ROOFING PRODUCTS WITH ZONES OF ALGAE-RESISTANT GRANULES AND METHOD OF MANUFACTURE

CROSS-REFERENCE TO RELATED APPLICATIONS

This application claims the benefit of priority of U.S. Provisional Patent Application No. 62/785,532, filed Dec. 27, 2018, which is hereby incorporated herein by reference in its entirety.

BACKGROUND OF THE DISCLOSURE

1. Field of the Disclosure

The present disclosure relates generally to roofing products, for example, shingles suitable for covering and protecting the roofs of houses, buildings and other structures. The present disclosure relates more particularly to roofing products having algae-resistant granules.

2. Technical Background

Roofing shingles, such as asphalt shingles, frequently include granules that provide color to the surface of the shingles as well as other characteristics. Over time, particularly in warmer humid climates, conventional shingles can develop dark blotches or streaks that are aesthetically unpleasant. These blotches and streaks are the result of the algae growth on the surface of the roofing product.

In order to reduce or eliminate the blotching and streaking caused by algae growth on the roofing products, they can be cleaned using a cleaning solution that includes a strong oxidizer such as bleach. However, maintaining shingles using such cleaning methods requires frequent treatment, as the effective duration of the cleaning is rather short. Algae growth can also be inhibited using biocides, such as metals and inorganic metal oxides.

To combat such growth, many roofing products include algae-resistant granules across the exposed surface of the shingle. Such granules may, for example, have a layer including an appropriate biocide, such as cuprous oxide and/or zinc oxide. Although algae-resistant granules are effective at combating algae growth, these granules are typically more expensive than standard granules. Accordingly, simply further increasing the amount of algae-resistant granules in order to inhibit algae growth in environments that are very warm and humid can substantially increase the cost of the roofing products.

The present inventors have determined that algae will spread very quickly once its growth has initiated. Therefore, a roofing shingle that is effective at inhibiting the initial formation of algae growth, while limiting the use of expensive algae-resistant granules, would be very attractive to builders and consumers.

SUMMARY OF THE DISCLOSURE

In one aspect, the present disclosure provides a roofing product including an upper section and an exposed section, the roofing product comprising:

- a substrate including a top surface and a bottom surface; and
- a plurality of zones of roofing granules disposed on the top surface of the substrate, the plurality of zones including:

- a first zone within the exposed section of the roofing product and comprising a first collection of algae-resistant roofing granules, the first zone having a first algae-resistance intensity;
  - a second zone within the exposed section of the roofing product and comprising a second collection of algae-resistant roofing granules, the second zone having a second algae-resistance intensity; and
  - a third zone within the exposed section of the roofing product and having a third algae-resistance intensity, wherein the first algae-resistance intensity is different from the third algae-resistance intensity.

In another aspect, the disclosure provides a method of manufacturing a roofing product according to the disclosure, the method comprising:

- providing a substrate including a top surface and a bottom surface; and
- depositing a plurality of zones of roofing granules on the top surface of the substrate, the plurality of zones including:
  - a first zone within the exposed section of the roofing product and comprising a first collection of algae-resistant roofing granules, the first zone having a first algae-resistance intensity;
  - a second zone within the exposed section of the roofing product and comprising a second collection of algae-resistant roofing granules, the second zone having a second algae-resistance intensity; and
  - a third zone within the exposed section of the roofing product and having a third algae-resistance intensity, wherein the first algae-resistance intensity is different from the third algae-resistance intensity.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

FIG. 10 provides a schematic view of a sheet of roofing material having two interlocking top layers having dragons teeth, before being cut into two top layers.

DETAILED DESCRIPTION

As described above, the present inventors have determined that algae will spread quickly once its growth has initiated, and that a roofing product that is effective at inhibiting the initial formation of algae growth would be very attractive to builders and consumers.

Accordingly, one aspect of the disclosure is a roofing product including an upper section and an exposed section. The roofing product includes a substrate including a top surface and a bottom surface, and a plurality of zones of roofing granules disposed on the top surface of the substrate. The plurality of zones includes a first zone within the exposed section of the roofing product and comprises a first collection of algae-resistant roofing granules, where the first zone has a first algae-resistance intensity. The zones also include a second zone within the exposed section of the roofing product and comprises a second collection of algae-resistant roofing granules, where the second zone has a second algae-resistance intensity. The zones also include a third zone within the exposed section of the roofing product that has a third algae-resistance intensity. The first algae-resistance intensity is different from the third algae-resistance intensity.

Figure 1A:
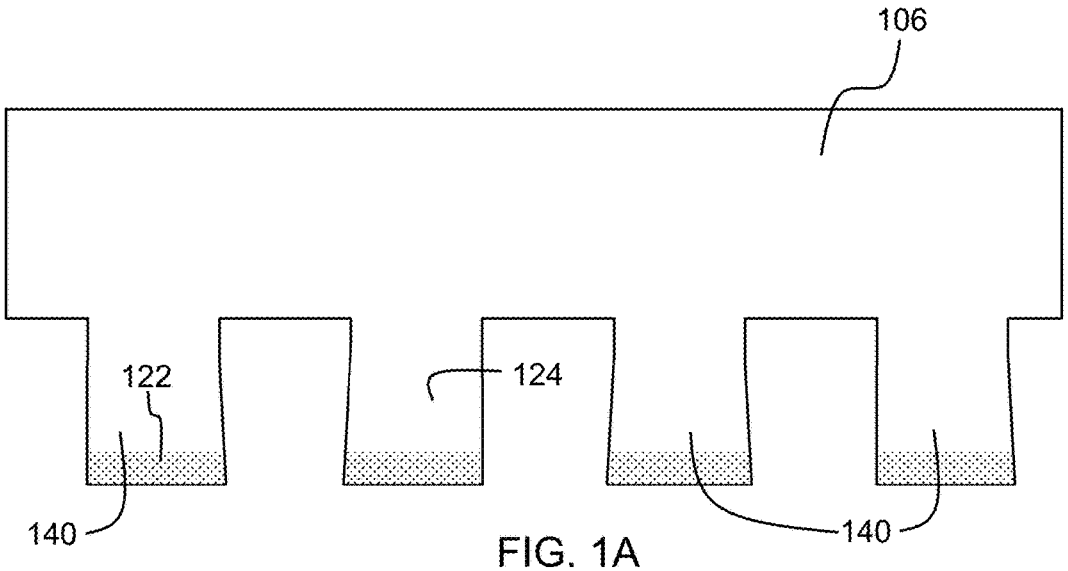
FIG. 1A is a schematic top view of a first portion of a roofing product in accordance with an embodiment of the disclosure.

Such a roofing product is shown in FIGS. 1A to 10. FIGS. 1A and 1B show portions of a laminated structure that are combined in FIG. 10 in a laminated roofing product 100 that has an exposed section 102 and an upper section 104. The two portions include a top layer 106 and a bottom layer 108 that together form a substrate 110 having a top surface 112 and a bottom surface 114. A plurality of zones 120, 122, 124 of roofing granules are disposed on the top surface 112 of the substrate 110. First zone 120 is disposed within the exposed section 102 and contains a number of roofing granules including a first collection of algae-resistant roofing granules, which impart a first algae-resistance intensity to the first zone 120. Second zone 122 is also disposed within exposed section 102 and also contains a number of roofing granules including a second collection of algae-resistant roofing granules, which imparts a second algae-resistance intensity to the second zone. Likewise, third zone 124 is also disposed within exposed section 102 and contains roofing granules that include a third collection of algae-resistant roofing granules that imparts a third algae-resistance intensity to the third zone. While all three zones 120, 122 and 124 in roofing product 100 include both algae-resistant roofing granules as well as conventional roofing granules, the algae-resistance intensity of the third zone differs from the first and second zones. The placement of these zones, which have different algae-resistance intensities allows for the controlled spatial distribution of antimicrobial elements to combat algae and other growth in targeted locations.

In certain embodiments as otherwise described herein, the roofing product is a roofing shingle, a roofing membrane, or a roofing tile. For example, roofing product 100 is a laminated asphalt roofing shingle. The substrate of roofing shingle 100 is formed of top and bottom layers 106, 108 that are each formed of a base sheet that is covered with a bituminous material to form an asphalt shingle. The base sheet of each of layers 106, 108 is formed of a fibrous mat that holds the bituminous material, for example, base sheet is made of woven or non-woven glass fibers, polymeric fibers, or a combination of glass and polymeric fibers. In other embodiments, the base sheet is made of roofing felt that holds the bituminous material. Further, the bituminous material an adhesive surface that holds the granules on the roofing product. In other embodiments, the substrate of the roofing product is made of thermoplastic, thermoset polymer, metallic, cementitious, or other materials as would be appreciated by those of ordinary skill in the art.

The terms top and bottom, as used herein, refer to the direction that is perpendicular to the angled underlying roof structure, such that a stack of two layers on the roof includes a bottom layer in contact with the underlying structure and a top layer that covers the bottom layer. In contrast, the terms upper and lower refer to the direction that is parallel to the roof structure with regard to elevation, such that water runs down the roof from an upper area of the roof to a lower area of the roof.

The roofing granules disposed on the top surface of the substrate of the roofing product described herein can have a range of different material constructions, as will be appreciated by those of ordinary skill in the art. In certain embodiments, as otherwise described herein, the roofing granules include a base particle having at least one coating layer disposed thereon. In some embodiments, the base particles include chemically inert materials, such as inert mineral particles, solid or hollow glass or ceramic spheres, or foamed glass or ceramic particles. In certain embodiments the base particles are inert mineral particles that are produced by a series of quarrying, crushing, and screening operations, and are generally intermediate between sand and gravel in size (that is, between about #8 US mesh and #70 US mesh). In some embodiments, the base particles have an average particle size of from about 0.1 mm to about 5 mm, e.g., from about 0.2 mm to 2.5 mm, e.g., from about 0.4 mm to about 2.4 mm.

In certain embodiments as otherwise described herein, the base particles include naturally occurring materials such as talc, slag, granite, silica sand, greenstone, andesite, porphyry, marble, syenite, rhyolite, diabase, greystone, quartz, slate, trap rock, basalt, and marine shells, as well as recycled manufactured materials such as crushed bricks, concrete, porcelain, fire clay, and the like. Crushed slate particles can also be used to form granules of a more or less flat morphology.

In certain embodiments the base particles are formed as solid or hollow glass spheres in a similar range of sizes. In some embodiments, the glass spheres are coated with a suitable coupling agent to provide improved adhesion to a binder included in a coating that surrounds the base particle.

As set forth above, at least some of the roofing granules used on the roofing products described herein are algae-resistant roofing granules. As described herein, algae-resistant roofing granules include granules that comprise an inorganic and/or organic algaecide disposed on the surface of or within the granule structure.

In certain embodiments as otherwise described herein, at least a portion of the algae-resistant granules include an inorganic algaecide. For example, in some embodiments, the inorganic algaecide is selected from the group consisting of copper oxide, other copper compounds, zinc oxide, titanium dioxide, silver, copper, zinc and mixtures thereof.

In certain embodiments as otherwise described herein, at least a portion of the algae-resistant granules include an organic algaecide. For example, in some embodiments, the organic algaecide includes one or more of zinc pyrithione, amines and ammonium salts, quaternary ammonium chloride, 4,5-dichloro-2-n-octyl-4-isothiazoline-3-one (DCOIT), tannin, hexahydro-1,3,5-tris(2-hydroxyethyl)-s-triazine, hexahydro-1,3,5-triethyl-s-triazine, 2-(tert-butylamino)-4-chloro-6-(ethylamino)-S-triazine, tetrahydro-3,5-dimethyl-2H-1,3,5-thiadiazine-2-thione, 3-iodo-2-propyl butyl carbamate, sodium dimethyldithiocarbamate, disodium ethylene bisdithiocarbamate, disodium cyanodithioimidocarbamate, potassium N-methyldithiocarbamate, potassium dimethyldithiocarbamate, 2,2-dibromo-3-nitrilopropionamide, 2,2-dibromo-2-nitroethanol, 2-bromo-2-nitro-1,3-propanediol, 2-methyl-2,3-dihydroisothiazol-3-one, 5-chloro-2-methyl-4-isothiazolin-3-one, 2-n-octyl-4-isothiazolin-3-one, chloroally-3,5,7-azoniaadamantane chloride, tetrakishydroxymethyl phosphonium sulfate, poly[oxyethylene(dimethyliminio)ethylene-(dimethyliminio)ethylene dichloride], didecyl dimethyl ammonium chloride, and dodecylguanidine hydrochloride.

In certain embodiments as otherwise described herein, the third zone includes a third collection of algae-resistant roofing granules. In other embodiments, the third zone is void of any algae-resistant roofing granules. For example, in some embodiments, the third zone does not include any roofing granules that comprise an algaecide or other biocide.

The difference in algae-resistance intensity, as described herein, includes any difference in the efficacy or manner in which the algae-resistant granules prevent algae growth within the vicinity of the corresponding zone of the roofing product. In some embodiments, the difference in the algae-resistance intensity includes a difference in the concentration of the algae-resistant granules within the zones. The phrase 'concentration of granules,' as used herein, refers to the weight percentage of algae-resistant granules to total granules per unit area. For example, two zones can have different algae-resistance intensities by including the same class of algae-resistant granules in each zone, but having different concentrations of the algae-resistant granules per unit area in each zone. In some embodiments, the difference in the algae-resistance intensity includes a difference in the algaecide concentration of the algae-resistant granules. The phrase 'algaecide concentration of algae-resistant granules' refers to the weight percentage of algaecide in a certain class of algae-resistant granules. For example, two zones can have different algae-resistance intensities by including the same concentration of algae-resistant granules in each of the zones, but including algae-resistant granules in one zone that have a relatively high concentration of algaecide and including algae-resistant granules in the other zone that have a relatively low concentration of algaecide. Thus, the zone with the algae-resistant granules that have a higher concentration of algaecide may have a greater algae-resistance efficacy or intensity, even if both zones have the same number of algae-resistant granules. Further, in some embodiments, the difference in algae-resistance intensity includes a difference in algaecide time-release characteristics. For example, in some embodiments, two zones can have different algae-resistance intensities by respectively including algae-resistant granules that have different algaecide release rates. As another example, in some embodiments, two zones can have different algae-resistance intensities by one of the zones including algae-resistant granules that have an algaecide release delay. Or the algae-resistant granules in different zones may have different algaecide release delays. Further, the zones having different algae-resistance intensities can have any combination of the above differentiating characteristics.

More specifically, in certain embodiments as otherwise described herein, the first zone has a first concentration of algae-resistant roofing granules, the second zone has a second concentration of algae resistant granules and the third zone has a third concentration of algae-resistant roofing granules, and wherein the first concentration is higher than the third concentration. As set forth above, in some embodiments, the third zone does not include any algae-resistant granules, and thus in these embodiments the third concentration of algae-resistant roofing granules is zero.

For example, in certain embodiments as otherwise described herein, the first zone includes a concentration of algae-resistant roofing granules in a range of 1% to 20%, e.g., in a range of 1% to 15%, e.g., in a range of 2% to 10%, e.g., in a range of 2% to 5%, e.g., in a range of 2% to 3%, or in a range of 3% to 4% or in arrange of 4% to 5%, or in a range of 5% to 10%, e.g., in a range of 5% to 8%, e.g., in a range of 5% to 6%, or in a range of 6% to 7%, or in a range of 7% to 8%, or in a range of 8% to 10%, e.g., 8% to 9% or 9% to 10%, or in a range of 10% to 15%, e.g., in a range of 10% to 12%, or in a range of 12% to 15%, or greater than 15%, or in a range of 15% to 20%, or greater than 20%, e.g., up to 100%.

Further, in certain embodiments as otherwise described herein, the third zone includes a concentration of algae-resistant roofing granules in a range of 0% to 15%, e.g., in a range of 1% to 10%, e.g., in a range of 1% to 5%, e.g., in a range of 1% to 2%, or in a range of 2% to 3%, or in a range of 3% to 4% or in arrange of 4% to 5%, or in a range of 5% to 10%, e.g., in a range of 5% to 8%, e.g., in a range of 5% to 6%, or in a range of 6% to 7%, or in a range of 7% to 8%, or in a range of 8% to 10%, e.g., 8% to 9% or 9% to 10%, or in a range of 10% to 15%, e.g., in a range of 10% to 12%, or in a range of 12% to 15%.

In certain embodiments as otherwise described herein, the concentration of algae-resistant roofing granules in the first zone is at least 1% higher than the concentration of algae-resistant roofing granules in the third zone, e.g., at least 2%, at least 3%, at least 5%, at least 7%, at least 9%, or at least 15% higher. In certain embodiments the concentration of algae-resistant roofing granules in the first zone is higher than the concentration of algae-resistant roofing granules in the third zone by an amount in a range of 1% to 12% higher, e.g., in a range of 1% to 3% higher, or in a range of 3% to 5% higher, or in a range of 5% to 7% higher, or in a range of 7% to 9% higher, or in a range of 9% to 12% higher. In other embodiments, the concentration of algae-resistant roofing granules in the first zone is higher than the concentration of algae-resistant roofing granules in the third zone by an amount in a range of 9% to 50% higher, e.g., in a range of 9% to 40% higher, or in a range of 9% to 30% higher.

In certain embodiments as otherwise described herein, the concentration of algae-resistant roofing granules in the second zone is different from the concentration of algae-resistant concentrations in the first zone and from the concentration of algae-resistant roofing granules in the third zone. For example, in some embodiments, the second concentration is between the first concentration and the third concentration. In other embodiments, the first and second concentrations of algae-resistant roofing granules are the same.

For example, in some embodiments, the second zone includes a concentration of algae-resistant roofing granules in a range of 1% to 20%, e.g., in a range of 1% to 15%, e.g., in a range of 1% to 10%, e.g., in a range of 1% to 5%, e.g., in a range of 1% to 2%, or in a range of 2% to 3%, or in a range of 3% to 4% or in arrange of 4% to 5%, or in a range of 5% to 10%, e.g., in a range of 5% to 8%, e.g., in a range of 5% to 6%, or in a range of 6% to 7%, or in a range of 7% to 8%, or in a range of 8% to 10%, e.g., 8% to 9% or 9% to 10%, or in a range of 10% to 15%, e.g., in a range of 10% to 12%, or in a range of 12% to 15%, or in a range of 15% to 20%, or greater than 20%, e.g., up to 100%.

In some embodiments, the concentration of algae-resistant roofing granules in the second zone is at least 0.5% higher than the concentration of algae-resistant roofing granules in the third zone, e.g., at least 1%, at least 2%, at least 3%, at least 5%, at least 7%, at least 9%, or at least 15% higher, or in a range of 1% to 12% higher, e.g., in a range of 1% to 3% higher, or in a range of 3% to 5% higher, or in a range of 5% to 7% higher, or in a range of 7% to 9% higher, or in a range of 9% to 12% higher; and the concentration of algae-resistant roofing granules in the first zone is higher than the concentration of algae-resistant roofing granules in the second zone, e.g., at least 0.5% higher, at least 1%, at least 2%, at least 3%, at least 5%, at least 7%, at least 9%, or at least 15% higher, e.g., in a range of 0.5% to 1% higher, e.g., in a range of 1% to 12% higher, e.g., in a range of 1% to 3% higher, or in a range of 3% to 5% higher, or in a range of 5% to 7% higher. In other embodiments, the concentration of algae-resistant roofing granules in the second zone is higher than the concentration of algae-resistant roofing granules in the third zone by an amount in a range of 9% to 50% higher, e.g., in a range of 9% to 40% higher, or in a range of 9% to 30% higher.

In certain embodiments as otherwise described herein, the first zone includes a first group of algae-resistant granules that have a first algaecide concentration that is different from an algaecide concentration of any of the granules of the third zone.

For example, in some embodiments, the first zone includes one class of algae-resistant granules, such that the entire first collection of algae-resistant roofing granules has the first algaecide concentration, while the third zone does not include any algae-resistant granules. In other embodiments, each of the first zone and the third zone includes a single class of algae-resistant granules, but the two classes of granules are different and have different algaecide concentrations. Still in other embodiments, the first zone includes a mix of different classes of algae-resistant granules, and at least one of the classes of granules, i.e., the class that makes up the first group of algae-resistant granules in the first zone, is not included in the third zone. In such a case, the third zone may have none, one, or more than one class of algae-resistant granules therein.

The algae-resistant granules can have a variety of concentrations of algaecide. In certain embodiments as otherwise described herein, the algae-resistant granules in the roofing product have algaecide concentrations in a range from 0.02% by weight to 50% by weight, e.g., in a range of 0.02% to 20%, e.g., in a range of 0.02% to 5%, e.g., in a range of 0.02% to 2% by weight, e.g., in a range from 0.05% to 1.0%, e.g., from 0.05% to 0.5%, e.g., from 0.1% to 0.2%. But the person of ordinary skill in the art will appreciate that other concentrations can be effective to provide algaecidal activity.

In certain embodiments as otherwise described herein, the first group of algae-resistant granules have a first algaecide concentration that is higher than any class of granules in the third zone.

In certain embodiments as otherwise described herein, the second zone includes a second group of algae-resistant granules that have a second algaecide concentration that is different than an algaecide concentration of any class of the granules in the first zone or the third zone. In other embodiments, the first group of algae-resistant granules has an algaecide concentration that is the same as a class of algae-resistant granules in the second zone. In other embodiments, the first algaecide concentration is higher than the second algaecide concentration.

As set forth above, in certain embodiments as otherwise described herein, the algae-resistant roofing granules include classes of granules that have different algaecide time-release characteristics. For example, in some embodiments, at least some of the roofing granules include a class of algae-resistant granules that have a barrier coating that substantially prevents algaecide release from the algae-resistant granules for a predetermined period. Likewise, in some embodiments, the granules include a class of algae-resistant granules that release algaecide therefrom at a different rate than at least one other class of algae-resistant granules in the roofing product. Such classes of algae-resistant granules that have different algaecide time-release characteristics are described in U.S. Pat. No. 9,334,654, which is hereby incorporated by reference herein in its entirety.

In particular, in certain embodiments as otherwise described herein, the first zone includes a first group of algae-resistant granules that have an algaecide time-release characteristic that is different from an algaecide time-release characteristic of any of the granules of the third zone. In other words, within the first zone, there is at least one class of granules that has a certain algaecide time-release characteristic and there are no granules in the third zone that have that same time-release characteristic. Thus, while the first and third zones may include some algae-resistant granules that are in the same class, there is at least one class of granules in the first zone that is not present in the third zone. For example, in certain embodiments, the first group of algae-resistant granules in the first zone have an algaecide release rate that is different from the algaecide release rate of any of the granules of the third zone. Likewise, in some embodiments, the first group of algae-resistant granules in the first zone have an algaecide release delay that is different from an algaecide release delay of any of the granules of the third zone.

In certain embodiments as otherwise described herein, the first zone includes a first group of algae-resistant granules that have an algaecide time-release characteristic that is different from an algaecide time-release characteristic of any of the granules of the second zone. For example, in some embodiments the first zone includes a group of algae-resistant granules that have an algaecide release delay that none of the granules in the third zone have. Likewise, in some embodiments the first zone includes a group of algae-resistant granules that have a faster time-release of algaecide than the granules in the third zone. In other embodiments, the first zone and second zone include the same class or classes of algae-resistant granules, and have the same time-release characteristics.

In certain embodiments as otherwise described herein, the second zone includes a second group of algae-resistant granules that have an algaecide time-release characteristic that is different from an algaecide time-release characteristic of any of the granules of the third zone. For example, in some embodiments the second zone includes a group of algae-resistant granules that have an algaecide release delay that none of the granules in the third zone have. Likewise, in some embodiments the second zone includes a group of algae-resistant granules that have a faster time-release of algaecide than the granules in the third zone.

In certain embodiments as otherwise described herein, an average algaecide release rate of the granules of the first zone is different from an average algaecide release rate of the granules of the third zone. Likewise, in certain embodiments, an average algaecide release delay of the granules of the first zone is different from an average algaecide release delay of the granules of the third zone.

As will be understood by those of ordinary skill in the art, the color of the granules may be imparted, for example, by coloring pigments that are included in the granules, such as in a binder of a coating on the base particle. Such pigments may include suitable metal oxides.

Color, as expressed herein, may be measured using a color space that is specified by a set of 1976 CIELAB (Commission Internationale de L'Eclairage) color space coordinates of L*, a*, and b*, wherein L* represents lightness of the color (L*=0 is black, and L=100 indicates diffuse white; specular white may be higher), a* represents a position between red/magenta and green (a* negative values indicate green while positive values indicate magenta), and b* represents a position between yellow and blue (b* negative values indicate blue and positive values indicate yellow).

In certain embodiments as otherwise described herein, the first collection of algae-resistant roofing granules has a different color than the third collection of algae-resistant roofing granules. For example, in some embodiments, the first collection of algae-resistant roofing granules and third collection of algae-resistant roofing granules have a color difference ΔE of at least 2, e.g., a ΔE of at least 5, e.g., a ΔE of at least 10. In some embodiments, the first collection of algae-resistant roofing granules and the second algae-resistant roofing granules have a color difference ΔE of at least 2, e.g., a ΔE of at least 5, e.g., a ΔE of at least 10. In other embodiments, the first collection of algae-resistant roofing granules and the second algae-resistant roofing granules have a similar color, or the same color. Further, in some embodiments, the second collection of algae-resistant roofing granules and the third algae-resistant roofing granules have a color difference ΔE of at least 2, e.g., a ΔE of at least 5, e.g., a ΔE of at least 10.

In certain embodiments, one of the first, second, or third zones provides a shadow formation that enhances the depth of three dimensional features of the roofing product. To allow the algae-resistant granules to blend with other granules within such a shadow formation, in some embodiments the algae-resistant roofing granules in one zone are darker than the granules in another zone. For example, in certain embodiments, the first collection of algae-resistant roofing granules and the third collection of algae-resistant roofing granules differ from each other in color by at least 2 L* CIE color units, e.g., at least 5 L* CIE color units, e.g., at least 10 L* color units. Further, in certain embodiments the first collection of algae-resistant roofing granules and the second collection of algae-resistant roofing granules differ from each other in color by at least 2 L* CIE color units, e.g., at least 5 L* CIE color units, e.g., at least 10 L* color units. Further still, in some embodiments, the second collection of algae-resistant roofing granules and the third collection of algae-resistant roofing granules differ from each other in color by at least 2 L* CIE color units, e.g., at least 5 L* CIE color units, e.g., at least 10 L* color units.

In certain embodiments as otherwise described herein, at least some of the roofing granules of the roofing product include a biocidal glass composition. Such biocidal glass compositions are described in U.S. Pat. No. 9,408,383, which is hereby incorporated by reference herein in its entirety. One aspect of roofing granules including such a biocidal glass composition in the coating of the granule, is that these roofing granules may be lighter in color than other algae resistant roofing granules that include one or more biocidal agents. Achieving a lighter-colored granule, such as a buff or cream colored granule, allows for a broader color palette for roofing products. In other embodiments, the roofing granules do not include a biocidal glass composition.

The term zones, as used herein with regard to the roofing granules, refer to areas of the top surface of the roofing product substrate where the make-up of the roofing granules has one or more unifying characteristic. In some cases, the zones may be contiguous areas of the top surface, but the zones may also include several non-contiguous areas, as described in examples below. On the other hand, two adjacent zones will have some identifiable boundary. In other words, two different zones cannot be both contiguous, have the same composition and concentration of granules, and be disposed on the same substrate layer, such that the boundary between the zones is indiscernible. Instead, different zones may be disposed at a distance from one another such that they are physically separated by an intervening zone, or they may have different granule compositions or mixtures, or they may be positioned on different layers of the roofing product.

Specifically, in certain embodiments as otherwise described herein, the first zone is disposed at a distance from the second zone. For example, roofing product 100 shown in FIG. 10, includes first zone 120 and second zone 122. Each of the zones 120, 122 include the same class of algae-resistant roofing granules at the same concentration, such that first zone 120 and second zone 122 have the same algae-resistance intensity. However, first zone 120 is disposed toward the upper end of exposed section 102, while second zone 122 is disposed toward the lower end of exposed section 102 at the lower edge 126 of substrate 110. Accordingly, first zone 120 is separated from second zone 122, in particular with third zone 124 positioned therebetween. Thus, the boundaries of first zone 120 and second zone 122 can be identified by third zone 124, which has a different concentration of algae-resistant granules than either first zone 120 or second zone 122.

Figure 1B:
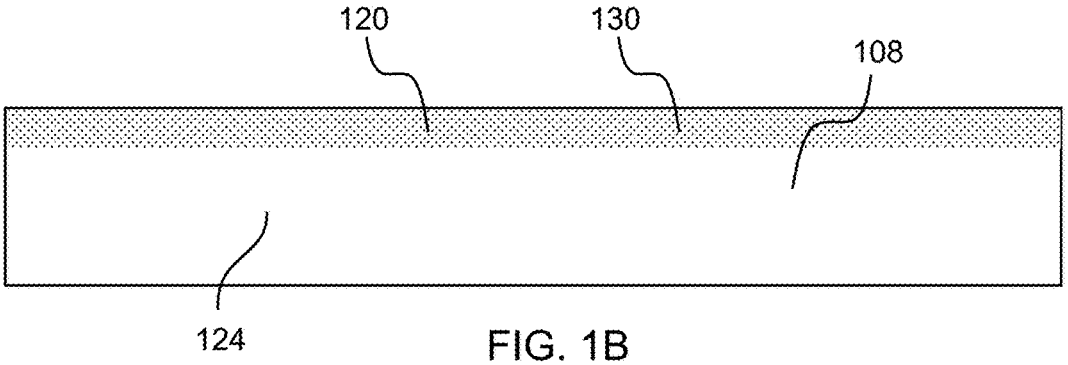
FIG. 1B is a schematic top view of a second portion of a roofing product that cooperates with the portion of FIG. 1A.
Figure 1C:
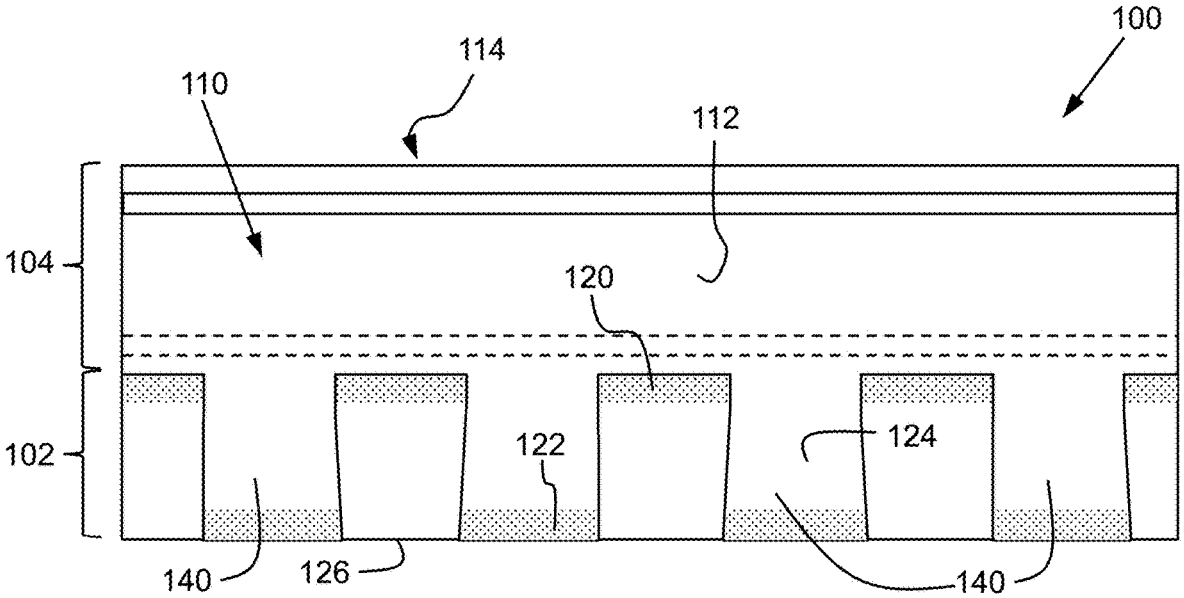

More specifically, first zone 120 is positioned in the shadow line at the upper edge of exposed section 102 on the shim formed by bottom layer 108. In particular, as shown in FIG. 1B, first zone 120 is formed by segments of an elongate area 130 on the shim 108 that is covered with the algae-resistant granules. The segments that form the first zone, are those segments of area 130 that are exposed between the dragon teeth 140 formed on the upper layer 106. Forming the first zone as an elongate area that is partially covered can be beneficial for manufacturing the roofing product, since the algae-resistant granules may be applied uniformly across the entire width of the roofing product. In other embodiments, segmented zones can be formed by algae-resistant granules that are discretely applied in specific areas on the top surface, without covering portions of the granules.

Further, second zone 122 of roofing product 100 is disposed at the lower edge of the dragon teeth 140.

First and second zones 120 and 122 each have higher concentrations of algae-resistant granules that third zone 124. The position of the first and second zones in the shadow line on the shim and at the bottom edge of the dragon teeth is beneficial in addressing enhanced algae growth resulting from water pooling and capillary effects. In particular, the increased concentration of algae-resistant granules on the shim at the shadow line combats algae growth heightened by moisture that gathers in the corners between the dragon teeth and at the edge of the upper portion or headlap. Likewise, the increased concentration of algae-resistant granules on the lower edge of the dragon teeth combat algae growth that is heighted by moister retention due to capillary effects at the bottom edge of the hanging dragon teeth.

Although roofing product 100 has zones of different algae-resistance intensity corresponding to differences in the concentration of algae-resistant granules, other embodiments of the roofing product have first, second, and third zones that are positioned on the roofing product in the same layout as roofing product 100, but have zones that differ in the algaecide concentration within the algae-resistant roofing granules, rather than the overall concentration of algae-resistant granules. Likewise, in other embodiments that have zones in these same locations, the zones have algae-resistant roofing granules with different time-release characteristics.

Figure 2:
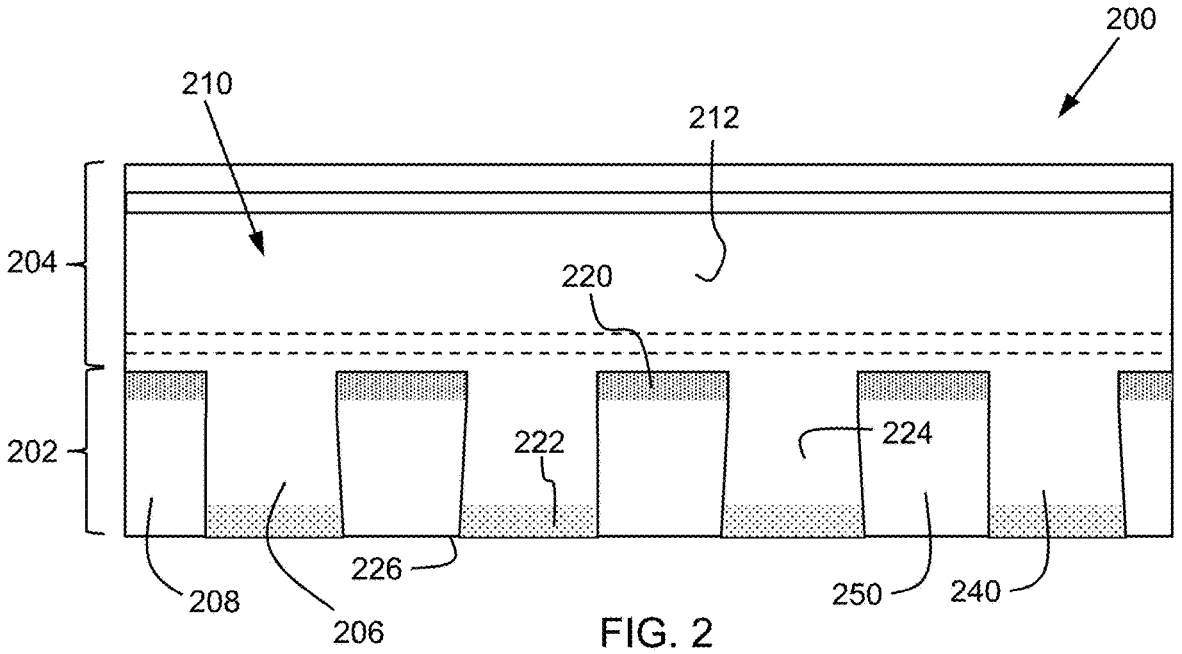
FIG. 2 is a schematic top view of another roofing product in accordance with an embodiment of the disclosure.

In certain embodiments as otherwise described herein, the second algae resistance intensity is different from the first algae resistance intensity and from the third algae-resistance intensity. An example of such a roofing product is shown in FIG. 2. Roofing product 200 is a laminated roofing shingle including a substrate 210 formed by a top layer 206 disposed over and adhered to a bottom layer 208. The top layer 206 includes an upper section 204 that forms a headlap of the shingle and dragon teeth 240 that hang down from the upper section 204 into an exposed section 202. The dragon teeth 240 partially cover a shim 250 formed by bottom layer 208 that is visible between the dragon teeth 240.

The substrate 210 includes a top surface 212 that is covered by a plurality of roofing granules organized into different zones. Specifically, the roofing granules form a first zone 220 at the upper edge of the exposed section 202 of the shingle in the shadow line, a second zone 222 at the lower edge 226 of dragon teeth 240 and a third zone 224 that covers the remaining area of the exposed section 202. The first zone 220 has a higher concentration of algae-resistant roofing granules than the second zone 222.

In other embodiments that have the same zone positioning as roofing product 200, the first zone includes granules with a higher algaecide concentration than the granules of the second zone. Still, in other embodiments with such zone positioning, the first zone includes granules that have a faster algaecide release rate than the granules of the second zone.

In certain embodiments as otherwise described herein, the second algae-resistance intensity is different from the first algae-resistance intensity and from the third algae-resistance intensity. For example, in roofing product 200, first zone 220 has a higher concentration of algae-resistant granules than second zone 222, which in turn has a higher concentration of algae-resistant granules than third zone 224.

In certain embodiments as otherwise described herein, the first zone is disposed at an upper edge of the exposed section of the roofing product. For example, in roofing product 200, first zone 220 is disposed between the dragon teeth 240 at the upper edge of exposed section 202 at the shadow line.

In certain embodiments as otherwise described herein, the first zone is disposed at an upper edge of the exposed section of the roofing product and the second zone is disposed at a lower edge of the exposed section of the roofing product. For example, in roofing product 200, second zone is disposed at the lower edge 226 of the exposed section 202 at the bottom of the dragon teeth.

Figure 3:
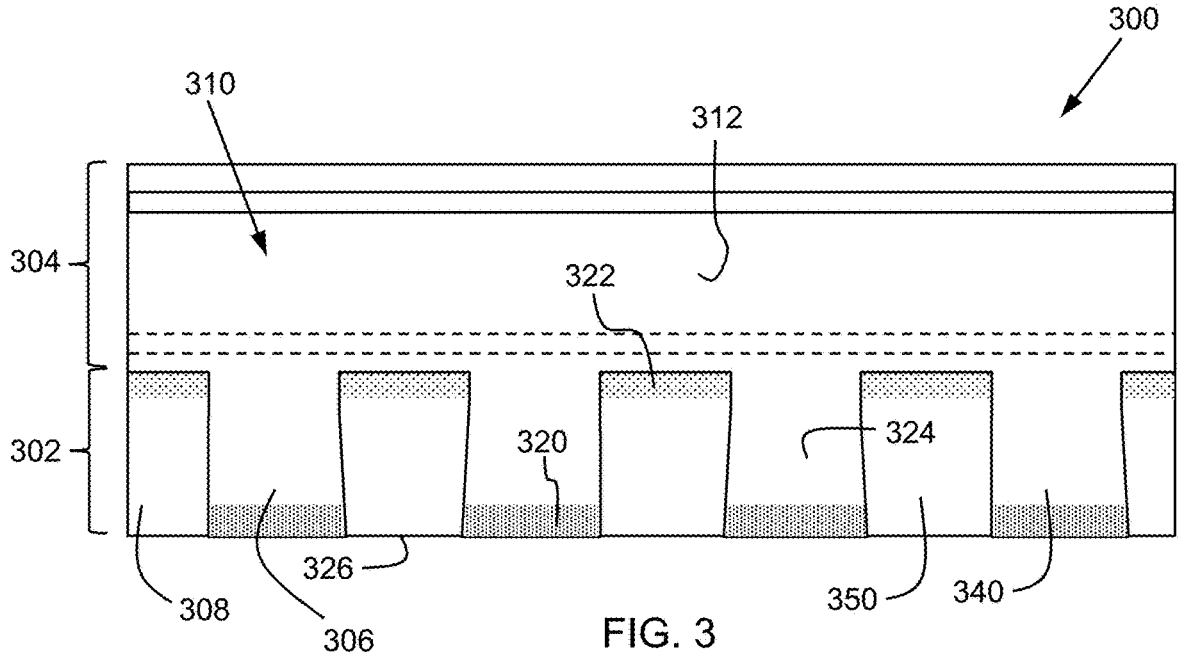
FIG. 3 is a schematic top view of another roofing product in accordance with an embodiment of the disclosure.

In certain embodiments as otherwise described herein, the first zone is disposed at a lower edge of the exposed section of the roofing product. Such an embodiment is shown in FIG. 3. Roofing product 300 is a laminated roofing shingle including a substrate 310 formed by a top layer 306 disposed over and adhered to a bottom layer 308. The top layer 306 includes an upper section 304 that forms a headlap of the shingle and dragon teeth 340 that hang down from the upper section 304 into an exposed section 302. The dragon teeth 340 partially cover a shim 350 formed by bottom layer 308 that is visible between the dragon teeth 340.

The substrate 310 includes a top surface 312 that is covered by a plurality of roofing granules organized into different zones. Specifically, the roofing granules form a first zone 320 at the lower edge of the exposed section 302 of the shingle at the lower edge 326 of the dragon teeth, a second zone 322 at the upper edge of exposed section 302 in the shadow line, and a third zone 324 that covers the remaining area of the exposed section 302. The first zone 320 has a higher concentration of algae-resistant roofing granules than the second zone 322.

In other embodiments that have the same zone positioning as roofing product 300, the first zone includes granules with a higher algaecide concentration than the granules of the second zone. Still, in other embodiments with such zone positioning, the first zone includes granules that have a faster algaecide release rate than the granules of the second zone.

In certain embodiments as otherwise described herein, the first zone is disposed at a lower edge of the exposed section of the roofing product and the second zone is disposed at an upper edge of the exposed section of the roofing product. For example, as explained above, roofing product 300 has such a configuration.

Figure 4:
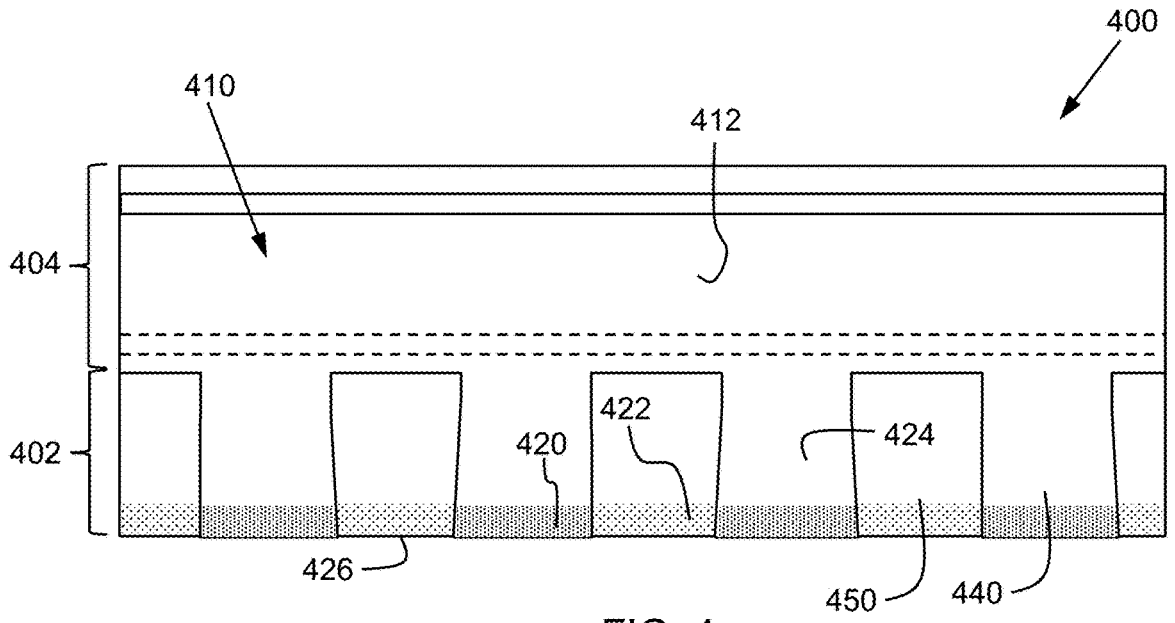
FIG. 4 is a schematic top view of yet another roofing product in accordance with an embodiment of the disclosure.

In certain embodiments as otherwise described herein, the first and second zones are disposed at a lower edge of the exposed section of the roofing product. Such an embodiment is shown in FIG. 4. Roofing product 400 is a laminated roofing shingle including a substrate 410 formed by a top layer 406 disposed over and adhered to a bottom layer 408. The top layer 406 includes an upper section 404 that forms a headlap of the shingle and dragon teeth 440 that hang down from the upper section 404 into an exposed section 402. The dragon teeth 440 partially cover a shim 450 formed by bottom layer 408 that is visible between the dragon teeth 440.

The substrate 410 includes a top surface 412 that is covered by a plurality of roofing granules organized into different zones. Specifically, the roofing granules form a first zone 420 at the lower edge 436 of the exposed section 402 of the shingle at the lower edge of the dragon teeth, a second zone 422 at the lower edge 436 of exposed section 402 at the lower edge of the shim, and a third zone 424 that covers the remaining area of the exposed section 402. The first zone 420 has a higher concentration of algae-resistant roofing granules than the second zone 422. In other embodiments, the first zone is disposed on the lower edge of the shim and the second zone is disposed on the lower edge of the dragon teeth.

In other embodiments that have the same zone positioning as roofing product 400, the first zone includes granules with a higher algaecide concentration than the granules of the second zone. Still, in other embodiments with such zone positioning, the first zone includes granules that have a faster algaecide release rate than the granules of the second zone.

In certain embodiments as otherwise described herein, the substrate has multiple layers, and wherein the first and second zones are disposed on different layers of the substrate. For example, roofing products 100, 200, 300 and 400 all include substrates with multiple layers where the first zone and second zone are on different layers. The terms "top layer" and "bottom layer," as used herein, are only limited by their relationship to one another, such that the top layer is above the bottom layer. These terms are not limited with respect to any additional layers. Accordingly, in some embodiments, the roofing product has additional layers each of which may individually be above, below, or between the top and bottom layers.

Figure 5:
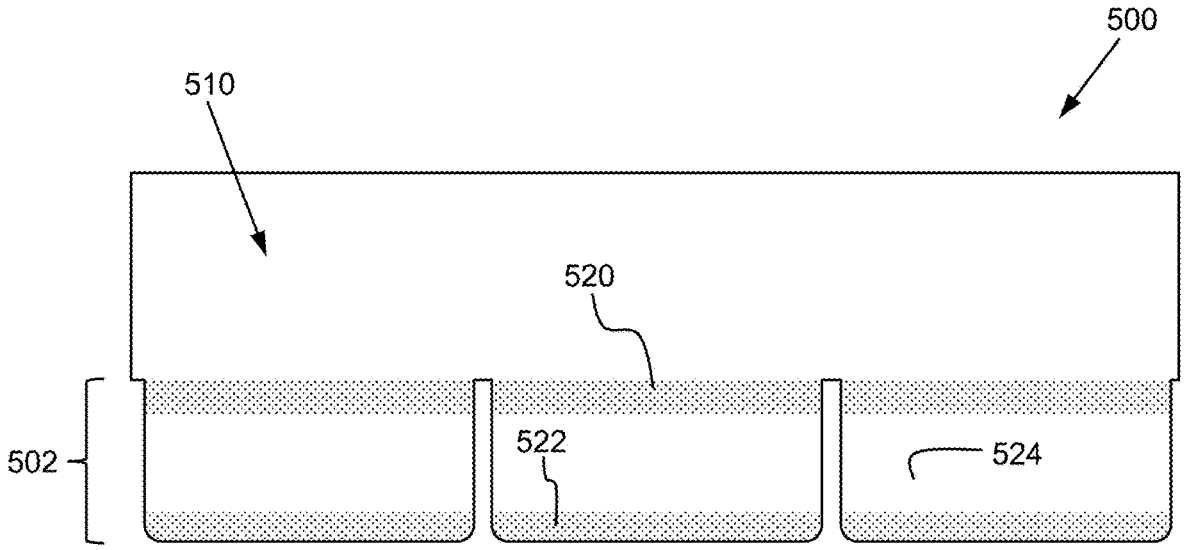
FIG. 5 is a schematic top view of a roofing product with a single substrate layer in accordance with an embodiment of the disclosure.
Figure 6:
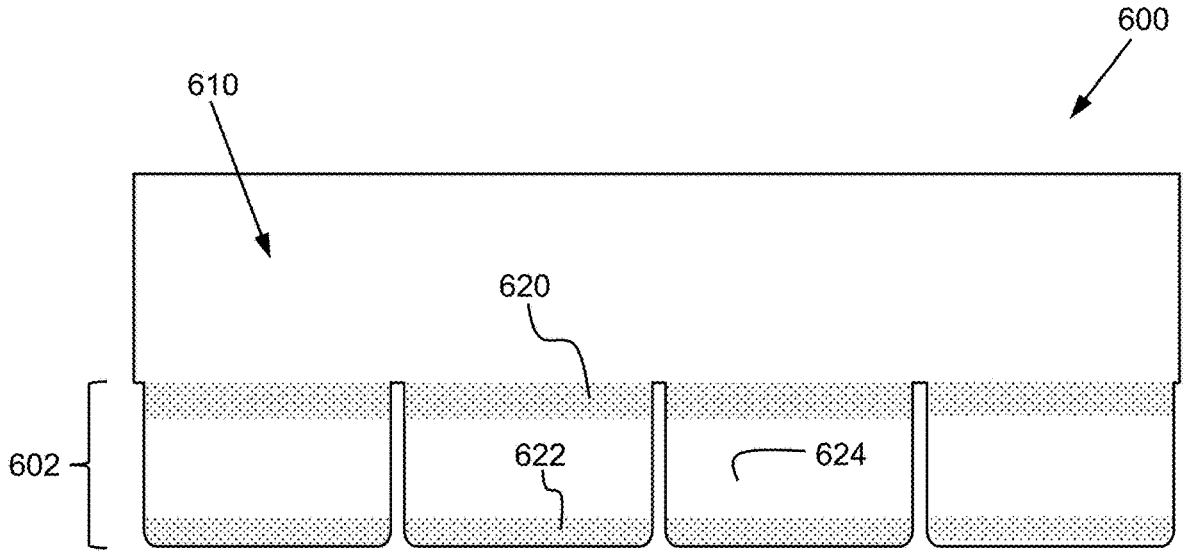
FIG. 6 is a schematic top view of a roofing product in accordance with an embodiment of the disclosure.
Figure 7:
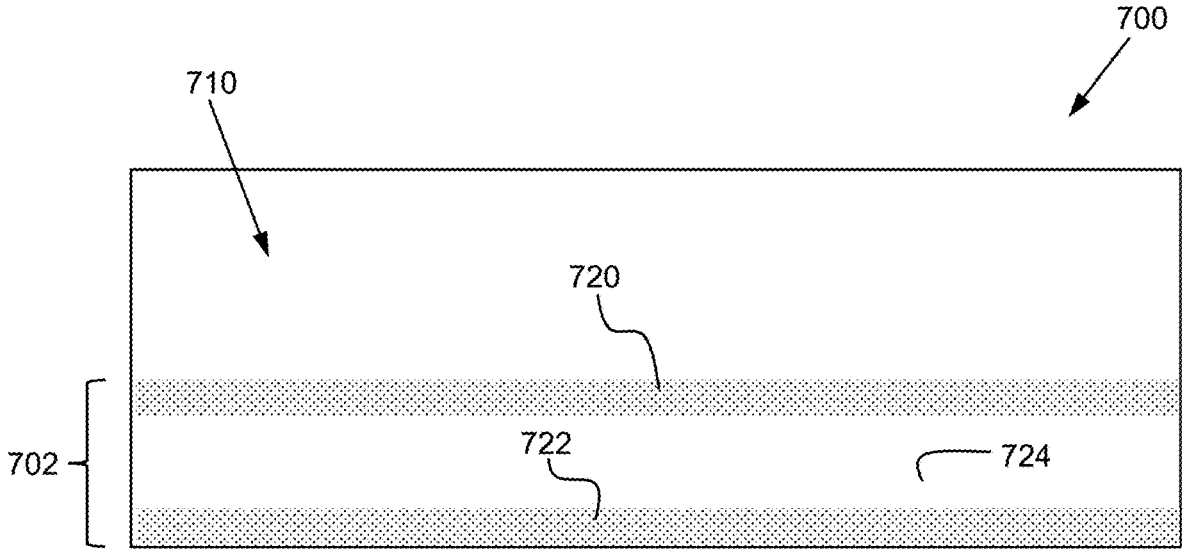
FIG. 7 is a schematic top view of another roofing product in accordance with an embodiment of the disclosure.
Figure 8:
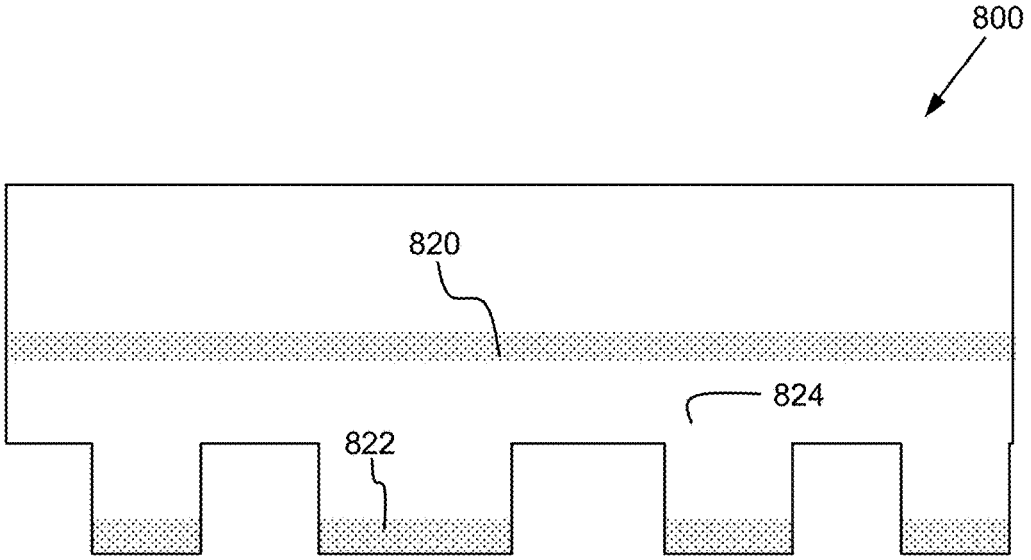
FIG. 8 is a schematic top view of yet another roofing product in accordance with an embodiment of the disclosure.

In other embodiments, the substrate has a single layer. For example, roofing product 500, shown in FIG. 5, is a three-tab shingle with a first zone 520, second zone 522 and third zone 524 disposed within an exposed section 502 on a top surface of the single-layered substrate 510. The first and second zones 520, 522 both have a higher concentration of algae-resistant granules than the third zone 524. Likewise, roofing product 600, shown in FIG. 6, is a four-tab shingle with a first zone 620, a second zone 622, and a third zone 624 disposed within an exposed section 602 on a top surface of the substrate 610. The first and second zones 620, 622 both have a higher concentration of algae-resistant granules than the third zone 624. Moreover, roofing product 700, shown in FIG. 7, is a straight roofing product including a first zone 720, a second zone 722, and a third zone 724 disposed within an exposed section 702 on a top surface of the substrate 710. First and second zones 720, 722 have a higher concentration of algae-resistant granules than third zone 724.

In certain embodiments as otherwise described herein, the first zone is disposed on a top layer of the substrate. In certain embodiments, the second zone is disposed on a bottom layer of the substrate. For example, in roofing product 300, first zone 320 is disposed on the top layer 306 on the dragon teeth and second zone 322 is disposed on bottom layer 308 on the shim.

In certain embodiments as otherwise described herein, the first zone is disposed on a bottom layer of the substrate. In certain embodiments, the second zone is disposed on a top layer of the substrate. For example, in roofing product 200, first zone 220 is disposed on the bottom layer 208 on the shim and second zone 222 is disposed on top layer 206 on the dragon teeth.

In certain embodiments as otherwise described herein, the substrate of the roofing product includes at least one tab that hangs downward from a body of the roofing product. For example, roofing product 800, shown in FIG. 8, has a substrate 810 that includes a body 842 and several tabs 840 that hang downward from body 842. The substrate 810 includes several zones of roofing granules in accordance with the disclosure, including a first zone 820 disposed in a shadow line adapted to be immediately lower than a lower edge of an overlaid roofing product. Substrate 810 also includes a second zone 822 disposed at the lower edge of the tabs 840. A third zone 824 is positioned between the first and second zones 820, 822. Further, first and second zones 820, 822 have a higher concentration of algae-resistant granules than third zone 824.

Figure 9:
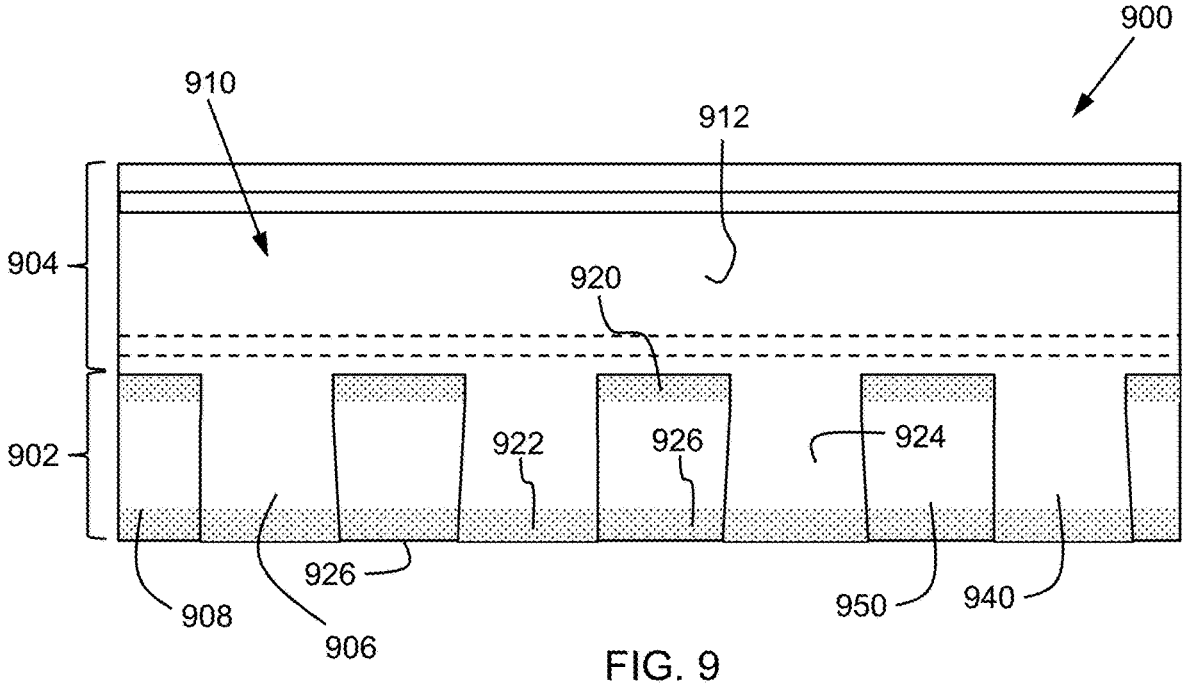
FIG. 9 is a schematic top view of another roofing product in accordance with an embodiment of the disclosure.

In certain embodiments as otherwise described herein, the roofing product includes a fourth zone within the exposed section that has an algae-resistance intensity that is different from that of the third zone. For example, such a roofing product is shown in FIG. 9. Roofing product 900 is a laminated roofing shingle including a substrate 910 formed by a top layer 906 disposed over and adhered to a bottom layer 908. The top layer 906 includes an upper section 904 that forms a headlap of the shingle and dragon teeth 940 that hang down from the upper section 904 into an exposed section 902. The dragon teeth 940 partially cover a shim 950 formed by bottom layer 908 that is visible between the dragon teeth 940.

The substrate 910 includes a top surface 912 that is covered by a plurality of roofing granules organized into different zones. Specifically, the roofing granules form a first zone 920 at the upper edge of the exposed section on the shim, a second zone 922 at the lower edge 936 of the exposed section 902 of the shingle at the lower edge of the dragon teeth, a fourth zone 926 at the lower edge 936 of exposed section 902 at the lower edge of the shim, and a third zone 924 that covers the remaining area of the exposed section 902. The first, second and fourth zones have higher concentrations of algae-resistant roofing granules than the third zone 924.

Figure 10:
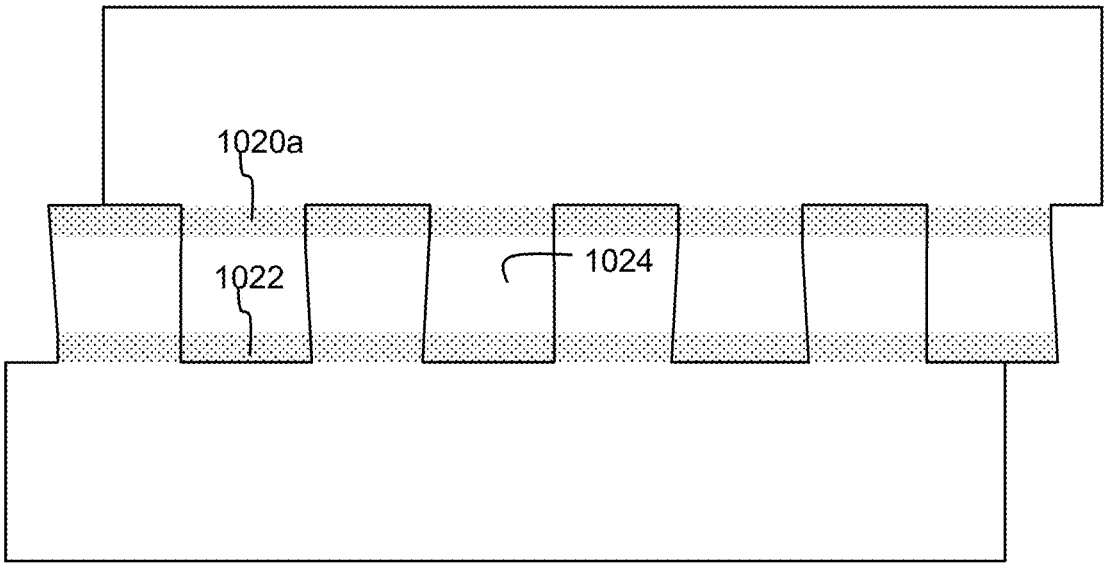
FIG. 10 is a schematic top view of a roofing product that combines the portions of FIGS. 1A and 1B.
Figure 11:
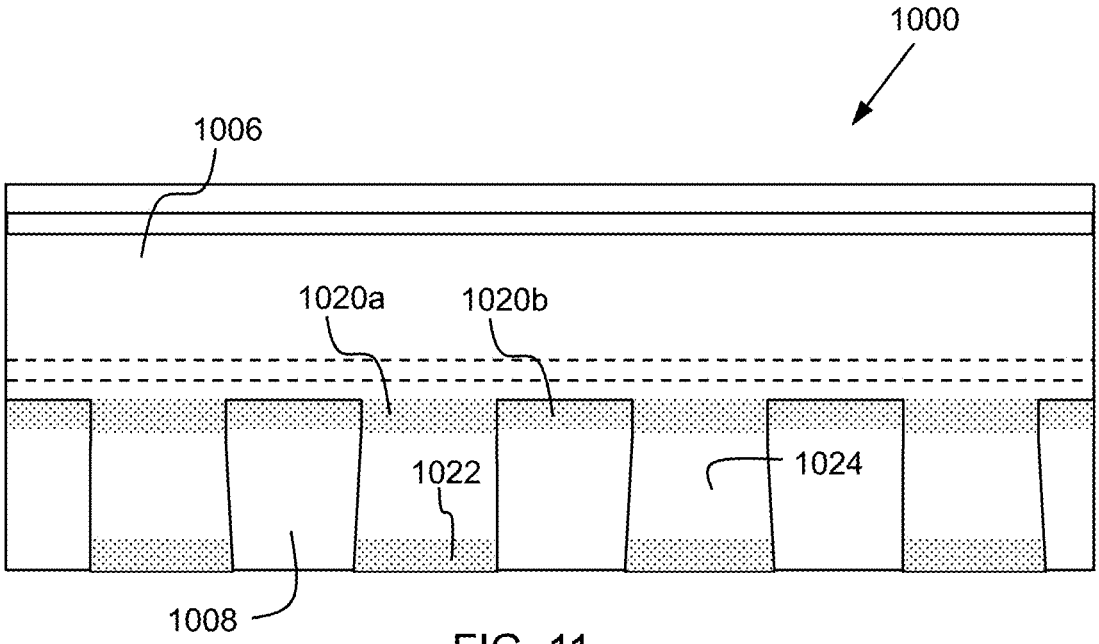
FIG. 11 provides a schematic view of a roofing product made from a top layer of FIG. 10.

The person of ordinary skill in the art will appreciate that conventional granule application techniques can be used to make the roofing products described herein. It can be convenient in such techniques to lay down granules in continuous stripes. Also, in conventional manufacture of multilayer roofing shingles, two top layers having dragons teeth (i.e., of any tab-like shape) is formed from a single sheet of material, then cut into two opposing top layers 1006, as shown in FIG. 10. In such cases, it can be convenient to lay down zones of algae-resistant roofing granules so that they are continuous. This can result in a zone 1022 along the lower edge of each dragon tooth 1024, and a zone **1020*a* along an upper edge of each dragons tooth. The resulting shingle 1000, formed from the top layer 1006 and a shim 1008, is shown in FIG. 11. This shingle also has a zone 1020*b*** along the exposed upper edge of the shim. Each of the previously described embodiments can be made in a likewise manner, and in thus in some cases can likewise include zones of algae-resistant granules along the upper edge of each dragons tooth.

In another aspect, the disclosure provides a method of manufacturing a roofing product according to any of the embodiments set forth above. The method includes providing a substrate including a top surface and a bottom surface. A plurality of zones of roofing granules are deposited on the top surface of the substrate. The plurality of zones include a first zone within the exposed section of the roofing product that includes a first collection of algae-resistant roofing granules, where the first zone has a first algae-resistance intensity. The plurality of zones also includes a second zone within the exposed section of the roofing product that includes a second collection of algae-resistant roofing granules, where the second zone has a second algae-resistance intensity. The plurality of zones also includes a third zone within the exposed section of the roofing product that has a third algae-resistance intensity, where the first algae-resistance intensity is different from the third algae-resistance intensity.

In certain embodiments as otherwise described herein, depositing the plurality of zones of roofing granules includes depositing the first collection of algae-resistant roofing granules in the first zone and depositing additional roofing granules in the first zone. The roofing granules can be deposited on the substrate using a variety of different tools, as will be appreciated by those of ordinary skill in the art. In some embodiments, the granules are deposited on the substrate using an applicator. For example, in some embodiments the applicator is configured to move over the top surface of the substrate while opening and closing to apply roofing granules to the substrate. In other embodiments the applicator is a roller that includes apertures that hold and release granules on the substrate as the applicator rolls over the top surface of the substrate.

In certain embodiments as otherwise described herein, the first collection of algae-resistant roofing granules is deposited in the first zone before the additional roofing granules are deposited in the first zone. For example, in some embodiments, the algae-resistant roofing granules are deposited in specific locations using an accurate applicator. The application of the algae-resistant roofing granules is then followed by depositing other roofing granules over the entire substrate surface to fill in voids surrounding the algae-resistant roofing granules.

In certain embodiments as otherwise described herein, providing the substrate includes applying a bituminous material to a base sheet, and depositing the zones of roofing granules includes depositing the granules on the bituminous material. For example, in some embodiments the method includes applying a bituminous material to a base sheet of roofing felt or a fiber mat. The roofing granules are then deposited and adhere to the bituminous material in order to produce an asphalt shingle with desirable algae-resistance.

The products and methods of the disclosure are further explained by the following non-limiting example:

EXAMPLE

Figure 12:
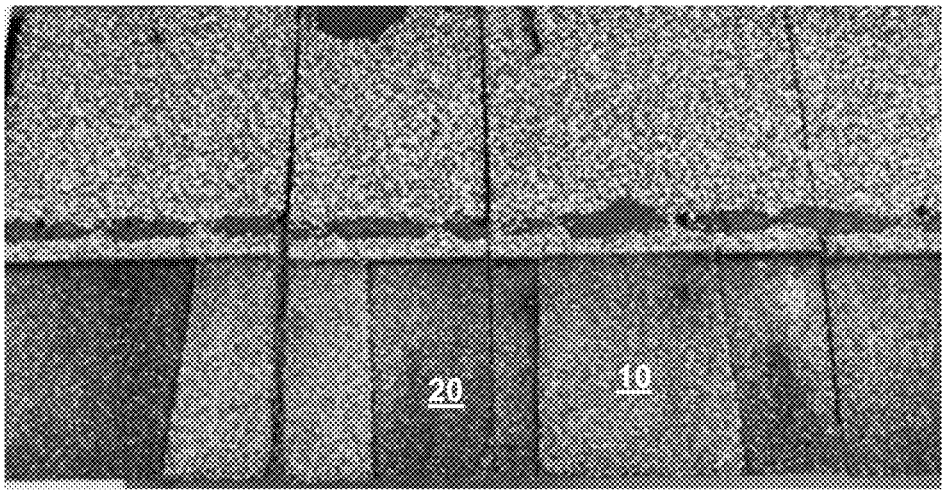
FIG. 12 provides a photograph of an example of algae growth on a roofing shingle in outdoor conditions.

FIG. 12 provides a photograph of an example of algae growth on a roofing shingle in outdoor conditions. Less algae is observed on the so-called "dragon teeth" 10, on which algae-resistant copper-containing granules are applied, than on the shim 20, on which no algae-resistant granules are applied. Moreover, more algae is seen at the corner and edges of the shim, and on the shim along the edge of the dragon teeth. The inventors surmise that this is due to relatively more water being physically retained on the shingle in these areas.

Figure 13:
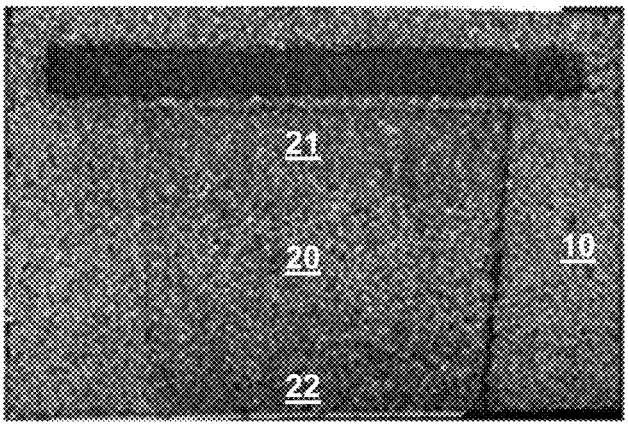
FIG. 13 provides a photograph of an example of algae growth on a roofing shingle in an algae-growth chamber.

FIG. 13 provides a photograph of an example of algae growth on a roofing shingle in an algae-growth chamber. Here, too, less algae is observed on the so-called "dragon teeth" 10, on which algae-resistant copper-containing granules are applied, than on the shim 20, on which no algae-resistant granules are applied. And on the shim, relatively more algae growth is observed along the shadow line 21 and along the bottom edge 22.

Figure 14:
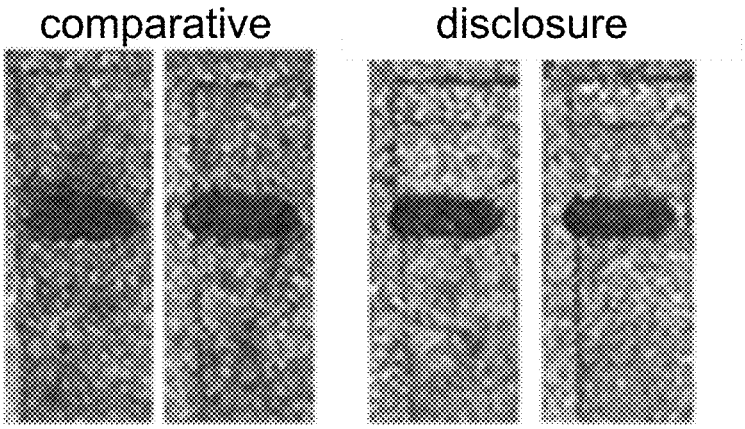
FIG. 14 provides photographs of comparative shingles and shingles of the disclosure in which the shadowline zone of the shim has 50% algae-resistant granules, after algae growth in an algae-growth chamber.

FIG. 14 provides photographs of comparative shingles like those in FIGS. 12 and 13 (i.e., no algae-resistant granules on the shim) and shingles of the disclosure in which the shadowline zone of the shim has 50% algae-resistant granules, after algae growth in an algae-growth chamber. The shingles of the disclosure exhibited much less algae growth on the shim, despite only having a portion of the shim including algae-resistant granules.

Further aspects of the disclosure are provided by the following non-limiting embodiments, which can be combined in any number and in any fashion that is not technically or logically inconsistent.

Embodiment 1

A roofing product including an upper section and an exposed section, the roofing product comprising:

a substrate including a top surface and a bottom surface; and a plurality of zones of roofing granules disposed on the top surface of the substrate, the plurality of zones including:

a first zone within the exposed section of the roofing product and comprising a first collection of algae-resistant roofing granules, the first zone having a first algae-resistance intensity;

a second zone within the exposed section of the roofing product and comprising a second collection of algae-resistant roofing granules, the second zone having a second algae-resistance intensity; and a third zone within the exposed section of the roofing product and having a third algae-resistance intensity, wherein the first algae-resistance intensity is different from the third algae-resistance intensity.

Embodiment 2

The roofing product according to embodiment 1, wherein the roofing product is a roofing shingle, a roofing membrane, or a roofing tile.

Embodiment 3

The roofing product according to embodiment 1 or embodiment 2, wherein the third zone includes a third collection of algae resistant roofing granules.

Embodiment 4

The roofing product according to any of embodiments 1 to 3, wherein the first zone has a first concentration of algae-resistant roofing granules, the second zone has a second concentration of algae resistant granules and the third zone has a third concentration of algae-resistant roofing granules, and wherein the first concentration is higher than the third concentration.

Embodiment 5

The roofing product according to embodiment 4, wherein the second concentration is different from the first and third concentrations.

Embodiment 6

The roofing product according to any of embodiments 1 to 5, wherein the first zone includes a concentration of algae-resistant roofing granules in a range of 1% to 20%, e.g., in a range of 1% to 15%, e.g., in a range of 2% to 10%, e.g., in a range of 2% to 5%, e.g., in a range of 2% to 3%, or in a range of 3% to 4% or in arrange of 4% to 5%, or in a range of 5% to 10%, e.g., in a range of 5% to 8%, e.g., in a range of 5% to 6%, or in a range of 6% to 7%, or in a range of 7% to 8%, or in a range of 8% to 10%, e.g., 8% to 9% or 9% to 10%, or in a range of 10% to 15%, e.g., in a range of 10% to 12%, or in a range of 12% to 15%, or in a range of 15% to 20%, or greater than 20%, e.g., up to 100%.

Embodiment 7

The roofing product according to any of embodiments 1 to 6, wherein the third zone includes a concentration of algae-resistant roofing granules in a range of 0% to 15%, e.g., in a range of 1% to 10%, e.g., in a range of 1% to 5%, e.g., in a range of 1% to 2%, or in a range of 2% to 3%, or in a range of 3% to 4% or in arrange of 4% to 5%, or in a range of 5% to 10%, e.g., in a range of 5% to 8%, e.g., in a range of 5% to 6%, or in a range of 6% to 7%, or in a range of 7% to 8%, or in a range of 8% to 10%, e.g., 8% to 9% or 9% to 10%, or in a range of 10% to 15%, e.g., in a range of 10% to 12%, or in a range of 12% to 15%.

Embodiment 8

The roofing product according to any of embodiments 1 to 7, wherein the concentration of algae-resistant roofing granules in the first zone is at least 1% higher than the concentration of algae-resistant roofing granules in the third zone, e.g., at least 2%, at least 3%, at least 5%, at least 7%, at least 9%, or at least 15% higher, or in a range of 1% to 12% higher, e.g., in a range of 1% to 3% higher, or in a range of 3% to 5% higher, or in a range of 5% to 7% higher, or in a range of 7% to 9% higher, or in a range of 9% to 12% higher, or in a range of 9% to 50% higher, or in a range of 9% to 40% higher, or in a range of 9% to 30% higher.

Embodiment 9

The roofing product according to any of embodiments 1 to 8, wherein the second zone includes a concentration of algae-resistant roofing granules in a range of 1% to 20%, e.g., in a range of 1% to 15%, e.g., in a range of 1% to 10%, e.g., in a range of 1% to 5%, e.g., in a range of 1% to 2%, or in a range of 2% to 3%, or in a range of 3% to 4% or in arrange of 4% to 5%, or in a range of 5% to 10%, e.g., in a range of 5% to 8%, e.g., in a range of 5% to 6%, or in a range of 6% to 7%, or in a range of 7% to 8%, or in a range of 8% to 10%, e.g., 8% to 9% or 9% to 10%, or in a range of 10% to 15%, e.g., in a range of 10% to 12%, or in a range of 12% to 15%, or in a range of 15% to 20%, or greater than 20%, e.g., up to 100%.

Embodiment 10

The roofing product according to any of embodiments 1 to 9, wherein the concentration of algae-resistant roofing granules in the second zone is at least 0.5% higher than the concentration of algae-resistant roofing granules in the third zone, e.g., in a range of 1% to 12% higher, e.g., in a range of 1% to 3% higher, or in a range of 3% to 5% higher, or in a range of 5% to 7% higher, or in a range of 7% to 9% higher, or in a range of 9% to 12% higher, and the concentration of algae-resistant roofing granules in the first zone is higher than the concentration of algae-resistant roofing granules in the second zone, e.g., at least 0.5% higher, e.g., in a range of 0.5% to 1% higher, e.g., in a range of 1% to 12% higher, e.g., in a range of 1% to 3% higher, or in a range of 3% to 5% higher, or in a range of 5% to 7% higher, or in a range of 9% to 50% higher, or in a range of 9% to 40% higher, or in a range of 9% to 30% higher.

Embodiment 11

The roofing product according to any of embodiments 1 to 10, wherein the first zone includes a first group of algae-resistant granules that have a first algaecide concentration that is different from an algaecide concentration of any of the granules of the third zone.

Embodiment 12

The roofing product according to any of embodiments 1 to 11, wherein the algae-resistant granules in the roofing product have algaecide concentrations in a range from 0.02% by weight to 50% by weight, e.g., in a range of 0.02% to 20%, e.g., in a range of 0.02% to 5%, e.g., in a range of 0.02% to 2% by weight, e.g., in a range from 0.05% to 1.0%, e.g., from 0.05% to 0.5%, e.g., from 0.1% to 0.2%.

Embodiment 13

The roofing product according to any of embodiments 1 to 12, wherein the first group of algae-resistant granules have a first algaecide concentration that is higher than any class of granules in the third zone.

Embodiment 14

The roofing product according to any of embodiments 1 to 13, wherein the second zone includes a second group of algae-resistant granules that have a second algaecide concentration that is different than an algaecide concentration of any class of the granules in the first zone or the third zone.

Embodiment 15

The roofing product according to embodiment 14, wherein the first algaecide concentration is higher than the second algaecide concentration.

Embodiment 16

The roofing product according to any of embodiments 1 to 15, wherein the first zone includes a first group of algae-resistant granules that have an algaecide time-release characteristic that is different from an algaecide time-release characteristic of any of the granules of the third zone.

Embodiment 17

The roofing product according to embodiment 16, wherein the first group of algae-resistant granules have an algaecide release rate that is different from the algaecide release rate of any of the granules of the third zone.

Embodiment 18

The roofing product according to embodiment 16 or embodiment 17, wherein the first group of algae-resistant granules have an algaecide release delay that is different from an algaecide release delay of any of the granules of the third zone.

Embodiment 19

The roofing product according to any of embodiments 1 to 18, wherein the first zone includes a first group of algae-resistant granules that have an algaecide time-release characteristic that is different from an algaecide time-release characteristic of any of the granules of the second zone.

Embodiment 20

The roofing product according to any of embodiments 1 to 19, wherein the second zone includes a second group of algae-resistant granules that have an algaecide time-release characteristic that is different from an algaecide time-release characteristic of any of the granules of the third zone.

Embodiment 21

The roofing product according to any of embodiments 16 to 20, wherein an average algaecide release rate of the granules of the first zone is different from an average algaecide release rate of the granules of the third zone.

Embodiment 22

The roofing product according to any of embodiments 16 to 21, wherein an average algaecide release delay of the granules of the first zone is different from an average algaecide release delay of the granules of the third zone.

Embodiment 23

The roofing product according to any of embodiments 1 to 22, wherein a color of the roofing granules in the first zone is different from a color of the roofing granules in the third zone.

Embodiment 24

The roofing product according to any of embodiments 1 to 23, wherein the first collection of algae-resistant roofing granules and third collection of algae-resistant roofing granules have a color difference ΔE of at least 2, e.g., a ΔE of at least 5, e.g., a ΔE of at least 10.

Embodiment 25

The roofing product according to any of embodiments 1 to 24, wherein the first collection of algae-resistant roofing granules and the third collection of algae-resistant roofing granules differ from each other in color by at least 2 L* CIE color units, e.g., at least 5 L* CIE color units, e.g., at least 10 L* color units.

Embodiment 26

The roofing product according to any of embodiments 1 to 25, wherein the first zone is disposed at a distance from the second zone.

Embodiment 27

The roofing product according to any of embodiments 1 to 26, wherein the second algae-resistance intensity is different from the first algae-resistance intensity and from the third algae-resistance intensity.

Embodiment 28

The roofing product according to any of embodiments 1 to 27, wherein the first zone is disposed at an upper edge of the exposed section of the roofing product.

Embodiment 29

The roofing product according to any of embodiments 1 to 28, wherein the first zone is disposed at a lower edge of the exposed section of the roofing product.

Embodiment 30

The roofing product according to embodiment 28 or embodiment 29, wherein the second zone is disposed at a lower edge of the exposed section of the roofing product.

Embodiment 31

The roofing product according to embodiment 29 wherein the second zone is disposed at an upper edge of the exposed section of the roofing product.

Embodiment 32

The roofing product according to any of embodiments 1 to 31, wherein the substrate has multiple layers, and wherein the first and second zones are disposed on different layers of the substrate.

Embodiment 33

The roofing product according to embodiment 32, wherein the first zone is disposed on a bottom layer of the substrate.

Embodiment 34

The roofing product according to embodiment 32 or embodiment 33, wherein the second zone is disposed on a top layer of the substrate.

Embodiment 35

The roofing product according to embodiment 32, wherein the first zone is disposed on a top layer of the substrate.

Embodiment 36

The roofing product according to embodiment 32 or embodiment 33, wherein the second zone is disposed on a bottom layer of the substrate.

Embodiment 37

A method of manufacturing a roofing product according to any of embodiments 1 to 36, the method comprising:

- providing a substrate including a top surface and a bottom surface; and
- depositing a plurality of zones of roofing granules on the top surface of the substrate, the plurality of zones including:
  - a first zone within the exposed section of the roofing product and comprising a first collection of algae-resistant roofing granules, the first zone having a first algae-resistance intensity;
  - a second zone within the exposed section of the roofing product and comprising a second collection of algae-resistant roofing granules, the second zone having a second algae-resistance intensity; and
  - a third zone within the exposed section of the roofing product and having a third algae-resistance intensity, wherein the first algae-resistance intensity is different from the third algae-resistance intensity.

Embodiment 38

The method according to embodiment 37, wherein depositing the plurality of zones of roofing granules includes depositing the first collection of algae-resistant roofing granules in the first zone and depositing additional roofing granules in the first zone.

Embodiment 39

The method according to embodiment 38, wherein the first collection of algae-resistant roofing granules is deposited in the first zone before the additional roofing granules are deposited in the first zone.

Embodiment 40

The method according to any of embodiments 37 to 39, wherein providing the substrate includes applying an bituminous material to a base sheet, and wherein depositing the zones of roofing granules includes depositing the granules on the bituminous material.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A roofing product including an upper section and an exposed section, the roofing product comprising:

a substrate including a top surface and a bottom surface; and a plurality of zones of roofing granules disposed on the top surface of the substrate, the roofing granules including algae-resistant roofing granules, the plurality of zones including:

a first zone within the exposed section of the roofing product and comprising a first collection of the algae-resistant roofing granules, the first zone having a first concentration of the algae-resistant roofing granules, wherein the first concentration of the algae-resistant roofing granules is the weight percentage of the algae-resistant roofing granules to total granules per unit area in the first zone;

a second zone within the exposed section of the roofing product and comprising a second collection of the algae-resistant roofing granules, the second zone having a second concentration of the algae resistant roofing granules, wherein the second concentration of the algae-resistant roofing granules is the weight percentage of the algae-resistant roofing granules to total granules per unit area in the second zone; and a third zone within the exposed section of the roofing product and comprising a third collection of the algae-resistant roofing granules, the third zone having a third concentration of the algae-resistant roofing granules, wherein the third concentration of the algae-resistant roofing granules is the weight percentage of the algae-resistant roofing granules to total granules per unit area in the third zone, wherein the first concentration is higher than the third concentration.

2. The roofing product according to claim 1, wherein the roofing product is a roofing shingle, a roofing membrane, or a roofing tile.

3. The roofing product according to claim 1, wherein the first concentration of the algae-resistant roofing granules is in a range of 1% to 20%, and the third concentration of the algae-resistant roofing granules is in a range of 0% to 15%.

4. The roofing product according to claim 1, wherein the first concentration of the algae-resistant roofing granules is at least 1% higher than the third concentration of the algae-resistant roofing granules.

5. The roofing product according to claim 1, wherein the second concentration of the algae-resistant roofing granules is in a range of 1% to 20%.

6. The roofing product according to claim 1, wherein the second concentration of the algae-resistant roofing granules is at least 0.5% higher than the third concentration of the algae-resistant roofing granules, and the first concentration of the algae-resistant roofing granules is at least 0.5% higher than the second concentration of the algae-resistant roofing granules.

7. The roofing product according to claim 1, wherein the algae-resistant roofing granules in the roofing product have algaecide concentrations in a range from 0.02% by weight to 50% by weight.

8. The roofing product according to claim 1, wherein the first zone includes a first group of the algae-resistant granules that have an algaecide time-release characteristic that is different from an algaecide time-release characteristic of any of the algae-resistant roofing granules of the second collection.

9. The roofing product according to claim 1, wherein the second zone includes a second group of the algae-resistant granules that have an algaecide time-release characteristic that is different from an algaecide time-release characteristic of any of the algae-resistant roofing granules of the third zone.

10. The roofing product according to claim 1, wherein a color of the algae-resistant roofing granules in the first zone is different from a color of the algae-resistant roofing granules in the third zone.

11. The roofing product according to claim 1, wherein the first collection of the algae-resistant roofing granules and the third collection of the algae-resistant roofing granules have a color difference $\Delta E$ of at least 2.

12. The roofing product according to claim 1, wherein the first collection of the algae-resistant roofing granules and the third collection of the algae-resistant roofing granules differ.

13. The roofing product according to claim 1, wherein the first zone is disposed at an upper edge of the exposed section of the roofing product or at a lower edge of the exposed section of the roofing product.

14. The roofing product according to claim 13, wherein the second zone is disposed at a lower edge of the exposed section of the roofing product or at an upper edge of the exposed section of the roofing product.

15. A method of manufacturing a roofing product according to claim 1, the method comprising:

providing a substrate including a top surface and a bottom surface; and depositing a plurality of zones of roofing granules on the top surface of the substrate, the plurality of zones including:

a first zone within the exposed section of the roofing product and comprising a first collection of the algae-resistant roofing granules, the first zone having a first concentration of the algae-resistant roofing granules, wherein the first concentration of the algae-resistant roofing granules is the weight percentage of the algae-resistant roofing granules to total granules per unit area in the first zone;

a second zone within the exposed section of the roofing product and comprising a second collection of the algae-resistant roofing granules, the second zone having a second concentration of the algae resistant roofing granules, wherein the second concentration of the algae-resistant roofing granules is the weight percentage of the algae-resistant roofing granules to total granules per unit area in the second zone; and a third zone within the exposed section of the roofing product and comprising a third collection of the algae-resistant roofing granules, the third zone having a third concentration of the algae-resistant roofing granules, wherein the third concentration of the algae-resistant roofing granules is the weight percentage of the algae-resistant roofing granules to total granules per unit area in the third zone.

* * * * *